US005216901A

United States Patent [19]

Okada

[11] Patent Number: 5,216,901

[45] Date of Patent: Jun. 8, 1993

[54] COMPOUND NEEDLE FOR KNITTING MACHINES

[75] Inventor: Toshihiko Okada, Ayabe, Japan

[73] Assignee: Gunze Kabushiki Kaisha, Kyoto, Japan

[21] Appl. No.: 582,832

[22] PCT Filed: Jan. 31, 1990

[86] PCT No.: PCT/JP90/00116

§ 371 Date: Oct. 5, 1990

§ 102(e) Date: Oct. 5, 1990

[87] PCT Pub. No.: WO90/09477

PCT Pub. Date: Aug. 23, 1990

[30] Foreign Application Priority Data

Feb. 8, 1989 [JP] Japan ..... 1-30374

[51] Int. Cl.[5] ..... D04B 35/06

[52] U.S. Cl. ..... 66/120; 66/123

[58] Field of Search ..... 66/120, 121, 122, 123, 66/124

[56] References Cited

U.S. PATENT DOCUMENTS

| | | | |
|---|---|---|---|
| 1,441,591 | 1/1923 | LaMontagne | 66/120 X |
| 1,727,769 | 9/1929 | Haveson | 66/120 X |
| 1,877,503 | 9/1932 | Gagne | 66/120 X |
| 1,884,090 | 10/1932 | Mills | 66/121 X |
| 1,887,166 | 11/1932 | Nuber | 66/120 X |
| 3,229,485 | 1/1966 | Peschl et al. | 66/120 |
| 3,828,582 | 8/1974 | Widdowson et al. | 66/120 X |
| 4,109,490 | 8/1978 | Bosch | 66/120 |
| 4,127,013 | 11/1978 | Nuber | 66/121 X |
| 4,196,600 | 4/1980 | Kohl | 66/120 |

FOREIGN PATENT DOCUMENTS

| | | | |
|---|---|---|---|
| 3331030 | 10/1984 | Fed. Rep. of Germany . | |
| 56-118934 | 9/1981 | Japan . | |
| 61-58582 | 12/1986 | Japan . | |
| 9003463 | 4/1990 | PCT Int'l Appl. | 66/120 |
| 329098 | 5/1930 | United Kingdom . | |
| 330041 | 6/1930 | United Kingdom | 66/121 |
| 2070075 | 11/1980 | United Kingdom . | |

*Primary Examiner*—Werner H. Schroeder
*Assistant Examiner*—John J. Calvert
*Attorney, Agent, or Firm*—Sixbey, Friedman, Leedom & Ferguson

[57] ABSTRACT

The invention provides a compound needle for knitting machines which is capable of winding a loop around another loop.

The compound needle has a needle body (2) with a hook (5) at its tip, and a slider (3) fitted in the body (2) and slidable longitudinally thereof for opening and closing the hook (5). The slider (3) has a recessed portion (13) for engaging a knitting yarn, and a pivotable latch (16) for opening and closing the recessed portion.

The hook (5) and the recessed portion (13) are opened and closed as controlled by controlling the movement of the needle body (2) and the slider (3).

9 Claims, 6 Drawing Sheets

FIG. 16
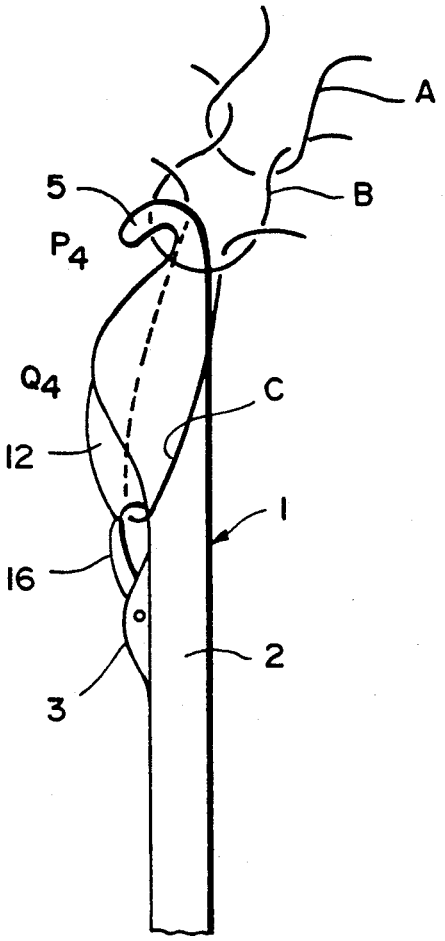
FIG. 17
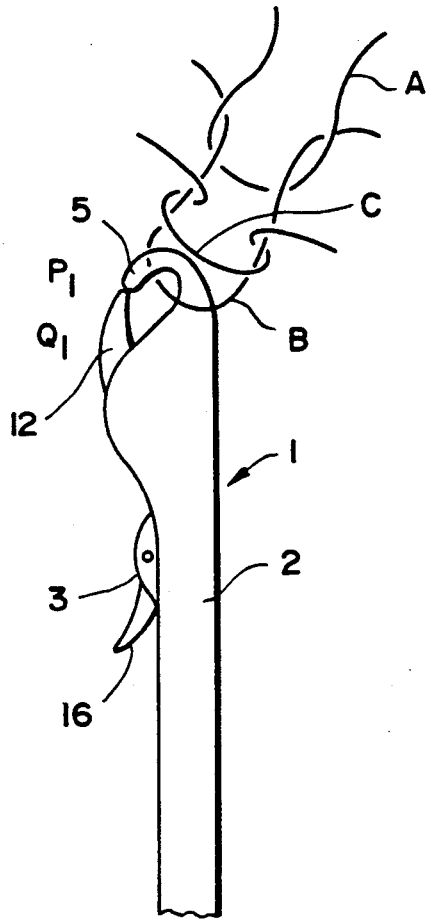
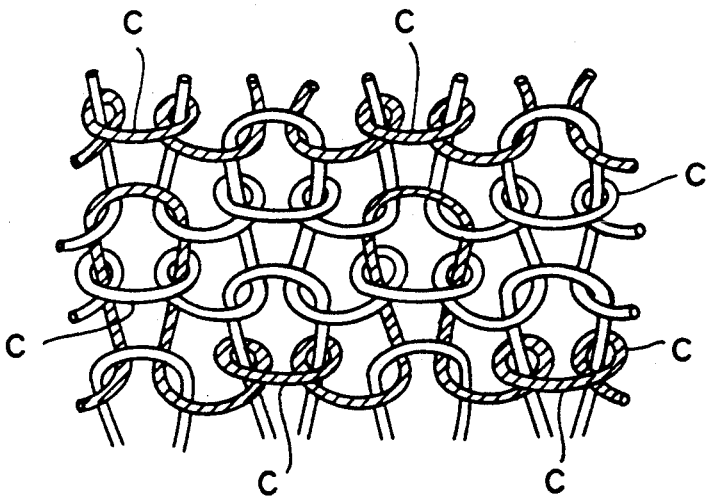
FIG. 18

COMPOUND NEEDLE FOR KNITTING MACHINES

Technical Field

The present invention relates to a compound needle for use in knitting machines for readily forming a loop wound around another loop.

BACKGROUND ART

Various proposals have heretofore been made for winding a loop around loop (see, for example, the specification of British Patent No. 329,098).

The British patent discloses a technique for forming a loop around another loop using a knitting needle which has a hook at the needle tip and a plurality of latches.

Theoretically, fabrics can be knitted with use of such needles.

In actuality, however, it was impossible to move the plurality of latches in the order disclosed in the specification of the British patent. Since it was conventionally impossible to control the movement of the plurality of latches, it was impossible to form a fabric wherein loops are provided around other loops.

Accordingly, no fabric is generally available commercially wherein one loop is wound around another loop.

On the other hand, compound needles are known which have a positively controllable latch (see, for example, the specification of U.S. Pat. No. 4,109,490).

The compound needle comprises a shank having a hook at its tip and a guide groove extending longitudinally thereof, and a plate slidably fitted in the guide groove. The hook can be opened or closed by the forward end of the plate by reciprocatingly moving the plate longitudinally thereof.

Nevertheless, a loop can not be drawn around another loop even with use of this compound needle.

To form one loop around another loop, two yarns must be engaged by a single needle at the same time, so that the single needle must be provided with a plurality of hooks or latches, and there arises a need to control the opening and closing of the hooks.

DISCLOSURE OF THE INVENTION

An object of the present invention is to provide a compound needle for knitting machines which is capable of winding a loop around another loop.

In order to wind a loop around another loop, it is necessary to provide at least two yarn engaging portions (hooks) on a single needle and to control the opening and closing of the engaging portions.

According to the present invention, the engaging portions are controlled for opening and closing by a compound needle.

More specifically, the present invention provides a compound needle comprising a needle body having a hook, and a slider slidably fitted in the body, the hook being openable and closable by the body and the slider. The needle is characterized in that the slider has a recessed portion and a pivoted latch for opening and closing the recessed portion.

The above object can be fulfilled by the needle of the above construction. With usual knitting needles having a hook and a pivoted latch for opening and closing the hook, the opening and closing of the hook are controlled by the longitudinal movement of the needle.

With the compound needle, on the other hand, the opening and closing of the hook are controlled by controlling the movement of the needle body and the slider relative to each other.

With the needle of the present invention wherein the slider has a recessed portion and a pivoted latch for opening and closing the recessed portion, the opening and closing of the recessed portion can be controlled by controlling the movement of the slider, and the opening and closing of the hook can be controlled by controlling the movement of the slider and the needle body relative to each other, with the result that the hook and the recessed portion can be opened or closed as controlled at the same time by suitably controlling the needle body and the slider.

According to the present invention, therefore, yarns can be engaged with the hook and the recessed portion or disengaged therefrom as controlled. This makes it possible to wind a loop around another loop.

Further according to the present invention, the needle body has a shank, the above-mentioned hook formed at the tip of the shank, a protuberance formed in the vicinity of the hook, a butt formed at the rear end of the shank and a guide groove formed in the shank and the protuberance and extending longitudinally of the body.

The slider has a shank, a fixed latch formed at the tip of the shank, the above-mentioned recessed portion formed in the vicinity of the fixed latch, a protrusion formed in the vicinity of the recessed portion, a groove formed in the protrusion, the above-mentioned pivoted latch free to open and close and supported in the protrusion groove and a butt formed at the rear end of the slider shank.

The fixed latch of the slider engages with or disengages from the hook of the needle body to close or open the hook when the slider reciprocatingly moves in the guide groove longitudinally thereof. The recessed portion of the slider is so positioned as to be hidden in the protuberance of the needle body when the fixed latch closes the hook and to be exposed from the protuberance of the needle body when the fixed latch opens the hook.

The needle body is formed from a plate by press work, the shank, protuberance and butt thereof are rectangular in cross section, and the hook is formed by forging and has a circular cross section.

The shank, protrusion and butt of the slider are rectangular in cross section.

The shank of the needle body has a uniform thickness over the entire length thereof, and the guide groove is U-shaped in cross section and formed centrally of the thickness of the shank.

The guide groove is formed in the forward half portion of the shank.

The slider has a small thickness at the portion thereof fitted in the guide groove of the needle body and has the same thickness as the needle body at the other portion thereof not fitting in the groove.

BRIEF DESCRIPTION OF THE DRAWINGS

FIGS. 12 to 17 are side elevations illustrating step by step how a loop is wound around another loop; and FIG. 18 is a diagram of a knitted structure including wound loops.

BEST MODE FOR CARRYING OUT THE INVENTION

Figure 1:
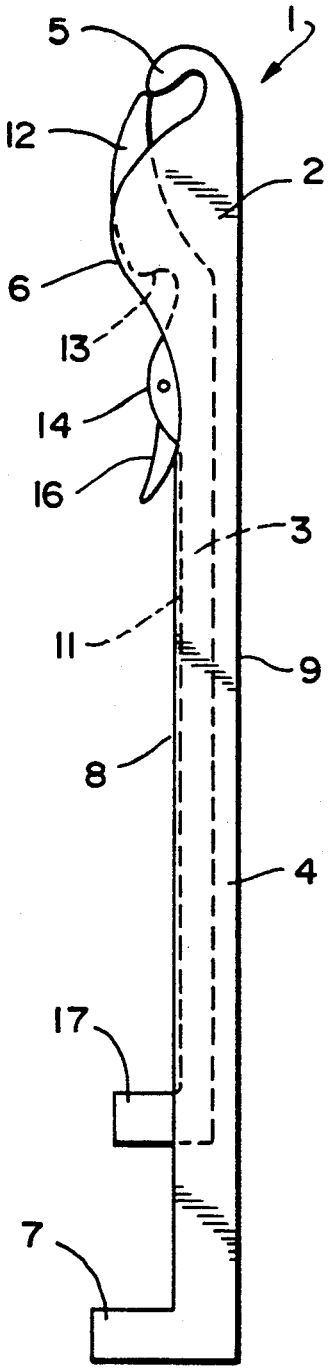
FIG. 1 is a side elevation of a compound needle for knitting machines.
Figure 2:
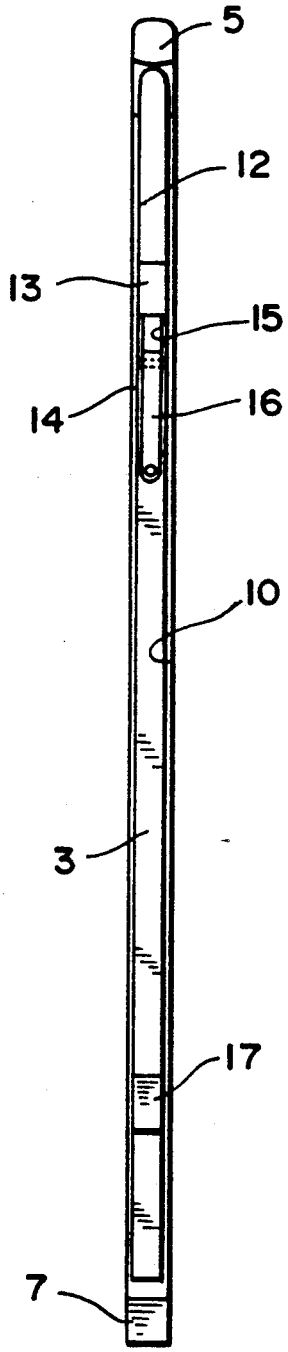
FIG. 2 is a front view of the same.
Figure 3:
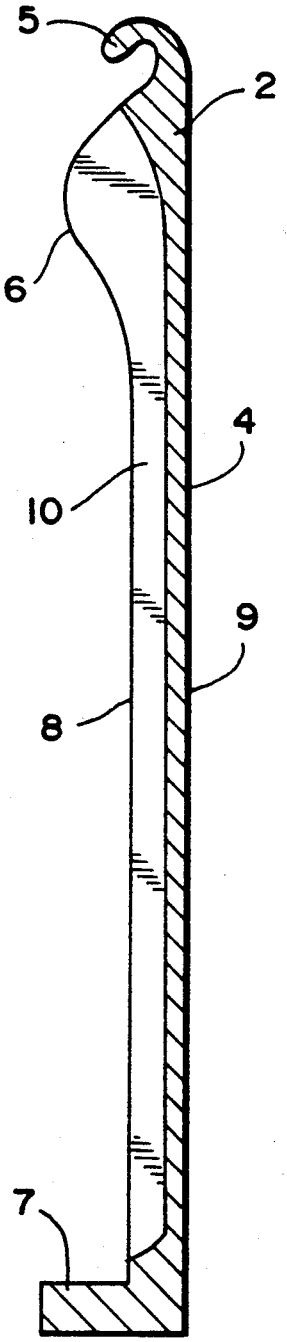
FIG. 3 is a sectional view of a needle body.
Figure 4:
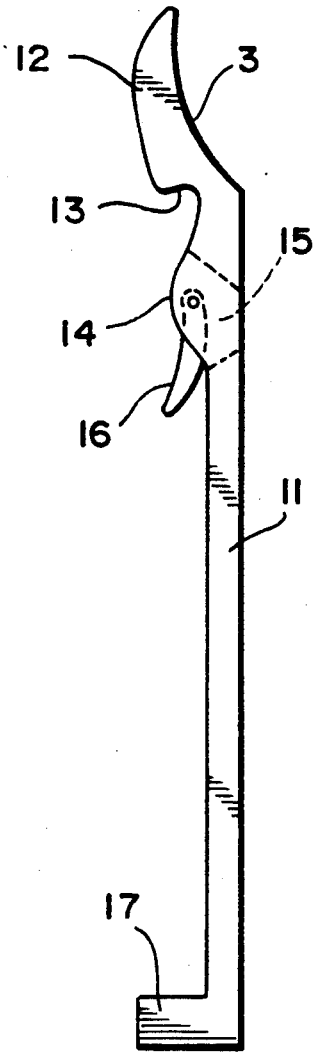
FIG. 4 is a side elevation of a slider.

Embodiments of the present invention will be described below with reference to the drawings.

Referring to FIGS. 1 to 4, a compound needle 1 for knitting machines comprises a needle body 2 and a slider 3.

The needle body 2 comprises a slender shank 4, a hook 5 formed at the tip of the shank 4 integrally with the tip, a protuberance 6 formed in the vicinity of the hook 5 integrally with the shank, and a butt 7 formed at the rear end of the shank 4 integrally therewith.

The shank 4 is rectangular in cross section and approximately uniform in thickness (sidewise dimension in FIG. 2) and in width (sidewise dimension in FIG. 1). The front face 8 (left-side face in FIG. 1) and the rear face 9 (right-side face in FIG. 1) of the shank 4 are formed straight.

The hook 5 is bent toward the front; that is, the hook 5 is open toward the front. The protuberance 6 is adjacent to the hook 5 and is formed on the front side 8 of the shank 4.

A guide groove 10 is formed in both the shank 4 and the protuberance 6 and extends longitudinally of the body. The guide groove 10 is U-shaped or recessed in cross section and formed centrally of the thickness of the shank 4 and the protuberance 6. It is open at the front side of the shank 4. The slider 3 is fitted in the guide groove 10 slidably longitudinally thereof.

The slider 3 comprises a slender shank 11, a fixed latch 12 formed at the tip of the shank 11 integrally therewith, a hooklike recesses portion 13 adjacent to the fixed latch 12, a protrusion 14 adjacent to the recessed portion 13 and integral with the shank 11, a groove 15 formed in the protrusion 14, a latch 16 pivotally movable and supported inside the groove 15, and a butt 17 formed at the rear end of the shank 11 integrally therewith.

The slider 3 is rectangular in cross section and has such a thickness as to slidably fit in the guide groove 10.

The tip of the fixed latch 12 engages with or disengages from the tip of the hook 5 of the needle body 2 when the slider 3 reciprocatingly moves in the guide groove 10 longitudinally thereof. Thus, the fixed latch 12 closes or opens the opening of the hook 5.

More specifically, upon the slider 3 moving upward to an upper position in FIG. 1, the tip of the fixed latch 12 comes into engagement with the tip of the hook 5, closing the opening of the hook 5. When the slider 3 moves down from the position of FIG. 1, the fixed latch 12 is hidden in the protuberance 6 of the needle body 2 to open the hook 5.

The recessed portion 13 of the slider 3 is so positioned as to be hidden in the protuberance 6 of the needle body 2 when the fixed latch 12 closes the hook 5 and to be exposed from the protuberance 6 when the fixed latch 12 opens the hook 5.

Figure 5:
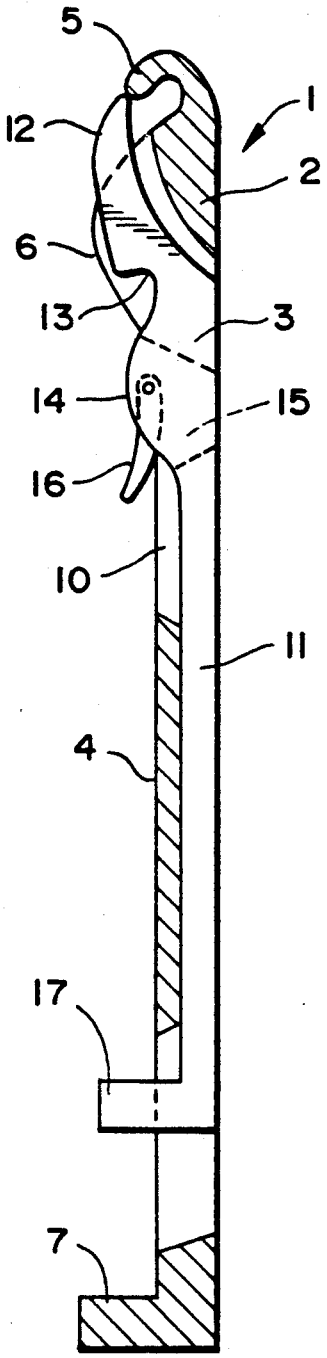
FIG. 5 is a sectional view of another embodiment of compound needle for knitting machines.

FIG. 5 shows another compound needle 1 for knitting machines which has substantially the same construction as the above needle except that it is different from the first embodiment in the opening direction of the guide groove 10 formed in the needle body 2. With the embodiment of FIG. 5, the guide groove 10 extends from the front side of the needle body to the rear side thereof at the forward portion and the tail portion of the groove 10, and is open at the rear side at an intermediate portion thereof.

Figure 6:
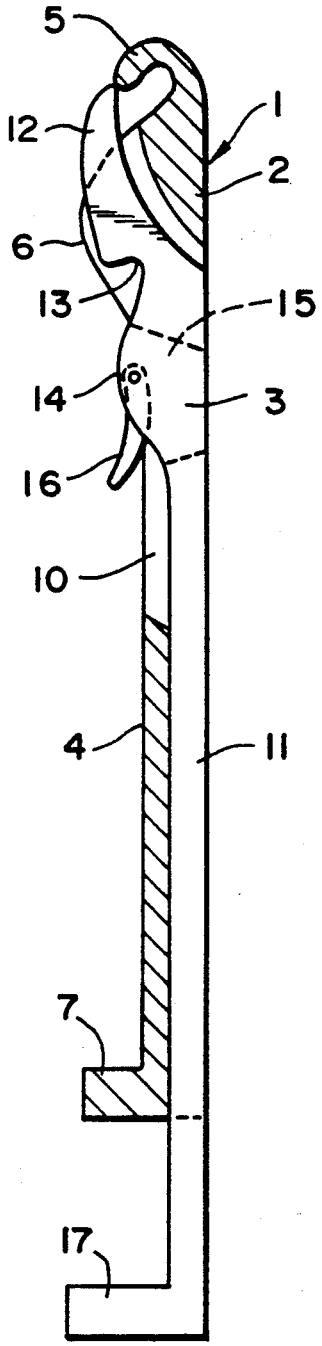
FIG. 6 is a sectional view of another embodiment of compound needle for knitting machines.
Figure 7:
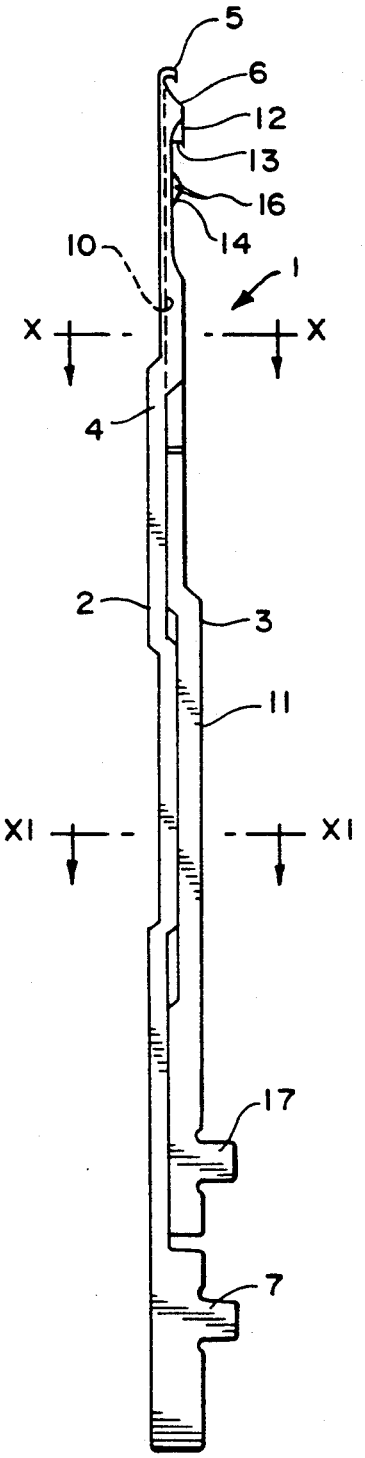
FIG. 7 is a side elevation showing another embodiment of compound needle for knitting machines.
Figure 8:
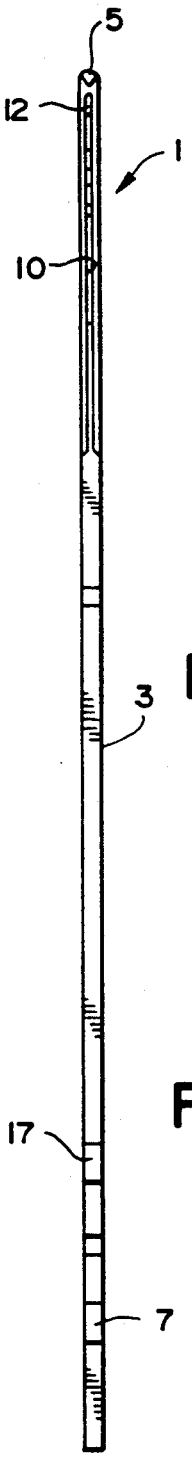
FIG. 8 is a front view of the same.
Figure 10:
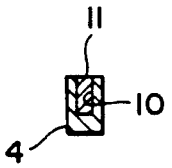
FIG. 10 is a view in section taken along the line X—X in FIG. 7.
Figure 11:
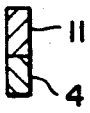
FIG. 11 is a view in section taken along the line XI—XI in FIG. 7.
Figure 9:
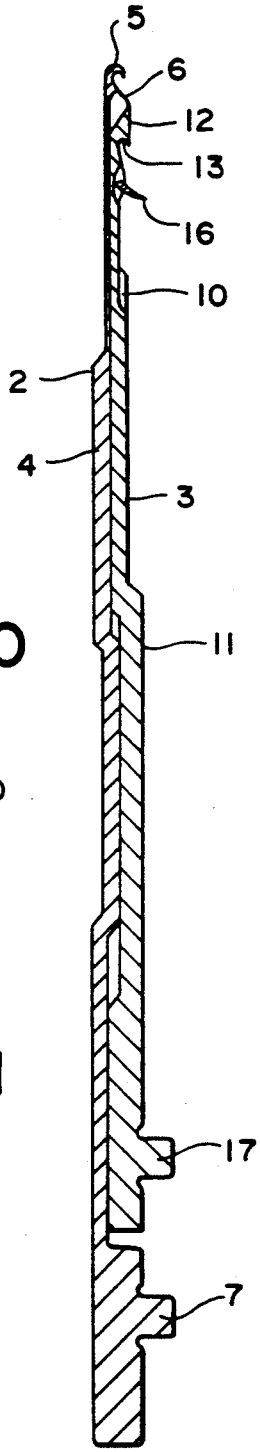
FIG. 9 is a sectional view of the same.

FIG. 6 shows another embodiment, which is approximately the same as the foregoing embodiments except that the tail end of the slider 3 is positioned below the tail end of the needle body 2.

FIGS. 7 to 11 show another embodiment which has basically the same construction as the foregoing embodiment but differs therefrom in configuration.

With this embodiment, the guide groove 10 has a shortened length to minimize the sliding resistance between the needle body 2 and the slider 3.

More specifically, the guide groove 10 is formed only in the forward half portion of the shank 4. The slider 3 has a small thickness at the portion thereof fitted in the guide groove 10 and has the same thickness as the needle body 2 at the other portion not fitting therein.

The needle body 2 is formed from a plate by press work, and the shank 4, protuberance 6 and butt 7 thereof are rectangular in cross section. The hook 5 is formed by forging and has a circular cross section.

Figure 12:
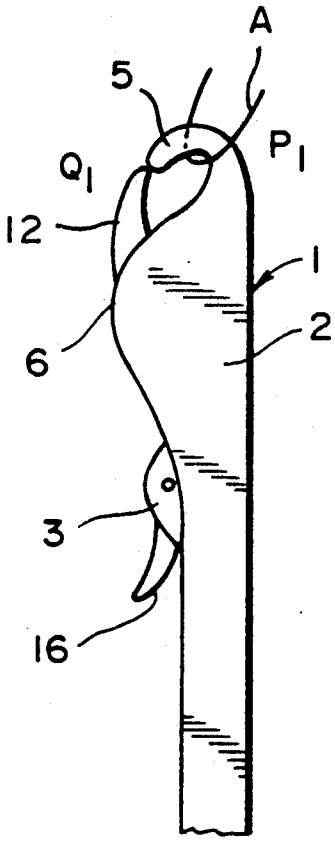

Next, the operation of the compound needle 1 for knitting a fabric will be described. First with reference to FIG. 12, the compound needle 1 is in a lower position, with the needle body 2 in a position P1 and with the slider 3 in a position Q1. The fixed latch 12 is in contact with the hook 4, and a loop A is in engagement with the hook 5.

Figure 13:
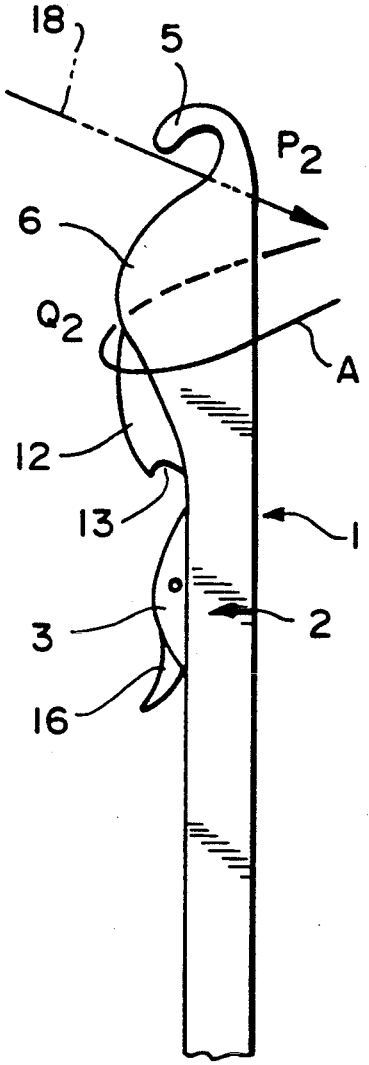

Subsequently, the needle 1 rises as seen in FIG. 13, raising the needle body 2 to a position P2 and the slider 3 to a position Q2, and the fixed latch 12 is positioned away from the hook 5. With the loop A in engagement with the hook 5, a knitting yarn 18 is fed to the hook 5.

Figure 14:
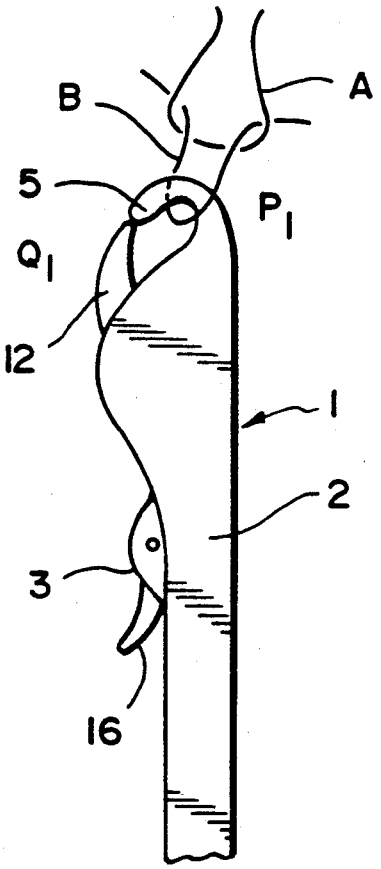

The needle 1 then descends as shown in FIG. 14, lowering the needle body 2 to the position P1 and the slider 3 to the position Q1. With the fixed latch 12 in contact with the hook 5, the loop A is slipped off to form the loop A in shape. A loop B remains in engagement with the hook 5.

Figure 15:
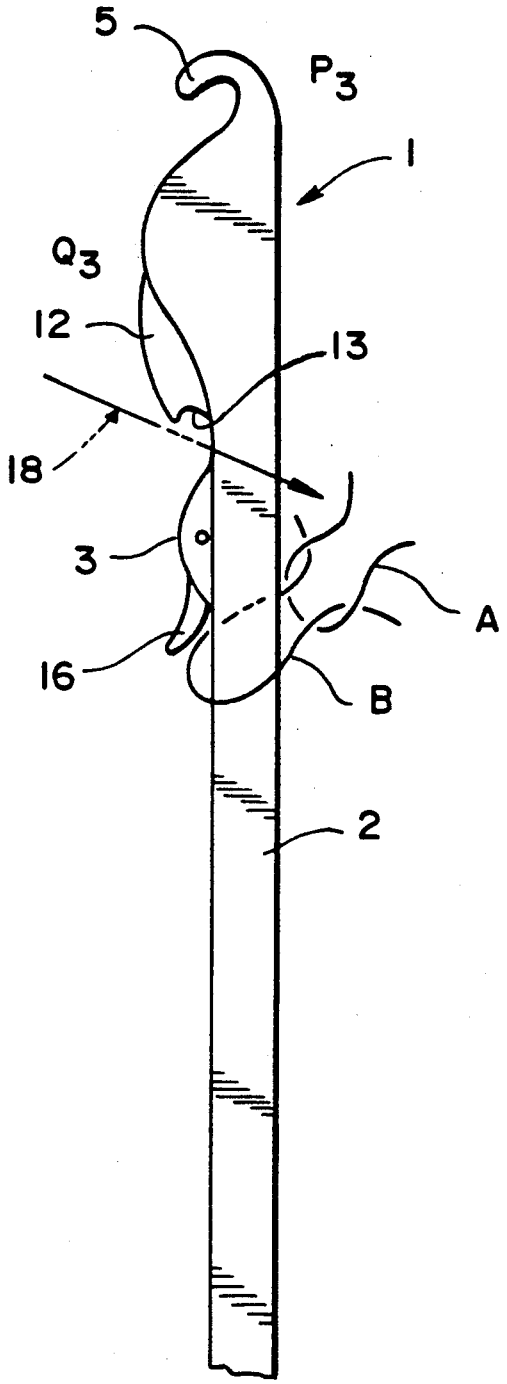

The needle 1 thereafter rises as shown in FIG. 15. More specifically, the needle body 2 ascends to a position P3, and the slider 3 to a position Q3, with the fixed latch 12 positioned away from the hook 5. In this state, the loop B is positioned below the latch 16, and a knitting yarn 18 is fed to the recessed portion 13 of the slider 3.

Next, the needle descends as seen in FIG. 16. The needle body 2 descends to a position P4, and the slider 3 to a position Q4, with the fixed latch 12 of the slider 3 positioned away from the hook 5. When the loop B is brought into engagement with the hook 5 in this state, a winding loop C is positioned to engage with the recessed portion 13.

The needle 1 further descends as shown in FIG. 17. More specifically, the needle body 2 descends to the position P1, and the slider 3 to the position Q1. With the fixed latch 12 in contact with the hook 5, the winding loop C is cast off and becomes wound around the loop B which is in engagement with the hook 5.

The steps of FIGS. 12 to 17 will be thereafter repeated for further knitting, or the knitting steps and process may be suitably modified or altered for knitting.

FIG. 18 is a diagram showing a knitted structure wherein wound loops C are suitably formed with use of compound needles of the present invention.

The present invention is not limited to the foregoing embodiments.

INDUSTRIAL APPLICATION

The compound needle of the present invention can be used for knitting machines.

I claim:

1. A compound needle for a knitting machine comprising a needle body (2) having a hook (5) at a tip end, and a slider (3) fitted in the body (2) and slidable longitudinally thereof for opening and closing the hook (5), wherein the slider (3) has a recessed portion (13) and a latch (16) pivotably provided for opening and closing the recessed portion (13).

2. A compound needle as defined in claim 1 wherein the needle body (2) has a shank (4), the hook (5) located at the tip end of the shank (4), a protuberance (6) formed in a vicinity of the hook (5), a butt (7) at a rear end of the shank (4), a guide groove (10) in the shank (4) and the protuberance (6) and extending longitudinally of the body, the slider (3) being slidably fitted in the guide groove (10).

3. A compound needle as defined in claim 2 wherein the slider (3) has a separate shank (11), the separate shank (11) form a fixed latch (12) at a tip, the recessed portion (13) in a vicinity of the fixed latch (12), a protrusion (14) formed in a vicinity of the recessed portion (13), a groove (15) formed in the protrusion (14), the pivotable latch (16) supported in the groove (15) and a butt (17) formed at the rear end of the separate shank (11).

4. A compound needle as defined in claim 3 wherein the fixed latch (12) of the slider (3) engages with or disengages from the hook (5) of the needle body (2) to close or open the hook (5) when the slider (3) reciprocatingly moves in the guide groove (10) longitudinally thereof, and the recessed portion (13) of the slider (3) is so positioned so as to be hidden by the protuberance (6) of the needle body (2) when the fixed latch (12) closes the hook (5) and to be exposed from the protuberance (6) of the needle body (2) when the fixed latch (12) opens the hook (5).

5. A compound needle as defined in claim 2 wherein the needle body (2) being formed from by pressing a plate, the shank (4), the protuberance (6) and the butt (7) thereof are rectangular in cross section, the hook (5) being formed by forcing and having a circular cross section.

6. A compound needle as defined in claim 3 wherein the shank (11), the protrusion (14) and the butt (17) of the slider (3) are rectangular in cross section.

7. A compound needle as defined in claim 5 wherein the shank (4) of the needle body (2) has a uniform thickness over the entire length thereof, and the guide groove (10) is U-shaped in cross section and formed centrally of the thickness of the shank (4).

8. A compound needle as defined in claim 7 wherein the guide groove (10) is formed in a forward half portion of the shank (4) of the needle body (2).

9. A compound needle as defined in claim 8 wherein the slider (3) has a reduced thickness at a portion thereof fitted in the guide groove (10) of the needle body (2) and has the same thickness as the needle body (2) at another portion thereof not fitted therein.

* * * * *